United States Patent [19]

Kavesh

[11] 3,960,200

[45] June 1, 1976

[54] APPARATUS FOR LIQUID QUENCHING OF FREE JET SPUN METAL

[75] Inventor: Sheldon Kavesh, Whippany, N.J.

[73] Assignee: Allied Chemical Corporation, New York, N.Y.

[22] Filed: Aug. 21, 1974

[21] Appl. No.: 499,386

Related U.S. Application Data

[62] Division of Ser. No. 306,472, Nov. 14, 1972, Pat. No. 3,845,805.

[52] U.S. Cl. ..... 164/281; 164/283 S

[51] Int. Cl.[2] ..... B22D 11/12

[58] Field of Search ..... 425/71, 70; 164/89, 164/281, 283 S

[56] References Cited

UNITED STATES PATENTS 2,907,082 10/1959 Pond ..... 164/89 X

FOREIGN PATENTS OR APPLICATIONS 2,145,706 10/1972 Germany ..... 425/71

*Primary Examiner*—Robert D. Baldwin

*Attorney, Agent, or Firm*—David W. Collins; Arthur J. Plantamura

[57] ABSTRACT

Apparatus is provided whereby filaments of metals may be formed by rapid solidification of a molten jet in a fluid medium. Filaments of metastable alloys such as amorphous metals and filaments of fine grained structure having novel orientation may be obtained.

6 Claims, 16 Drawing Figures

FIG. 3
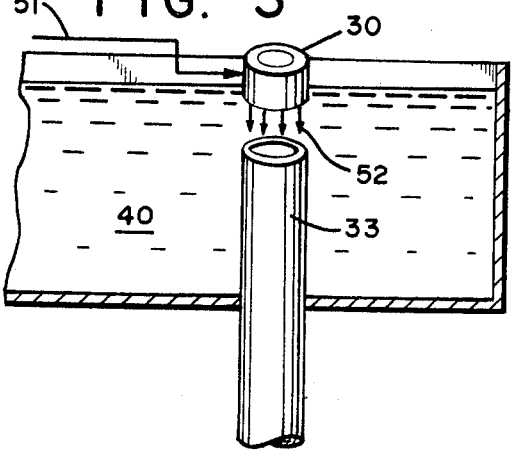
FIG. 3a
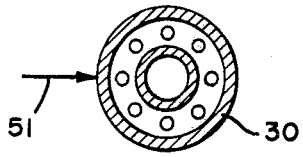
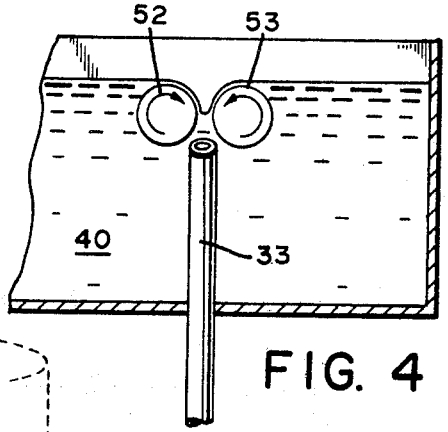
FIG. 4
FIG. 5
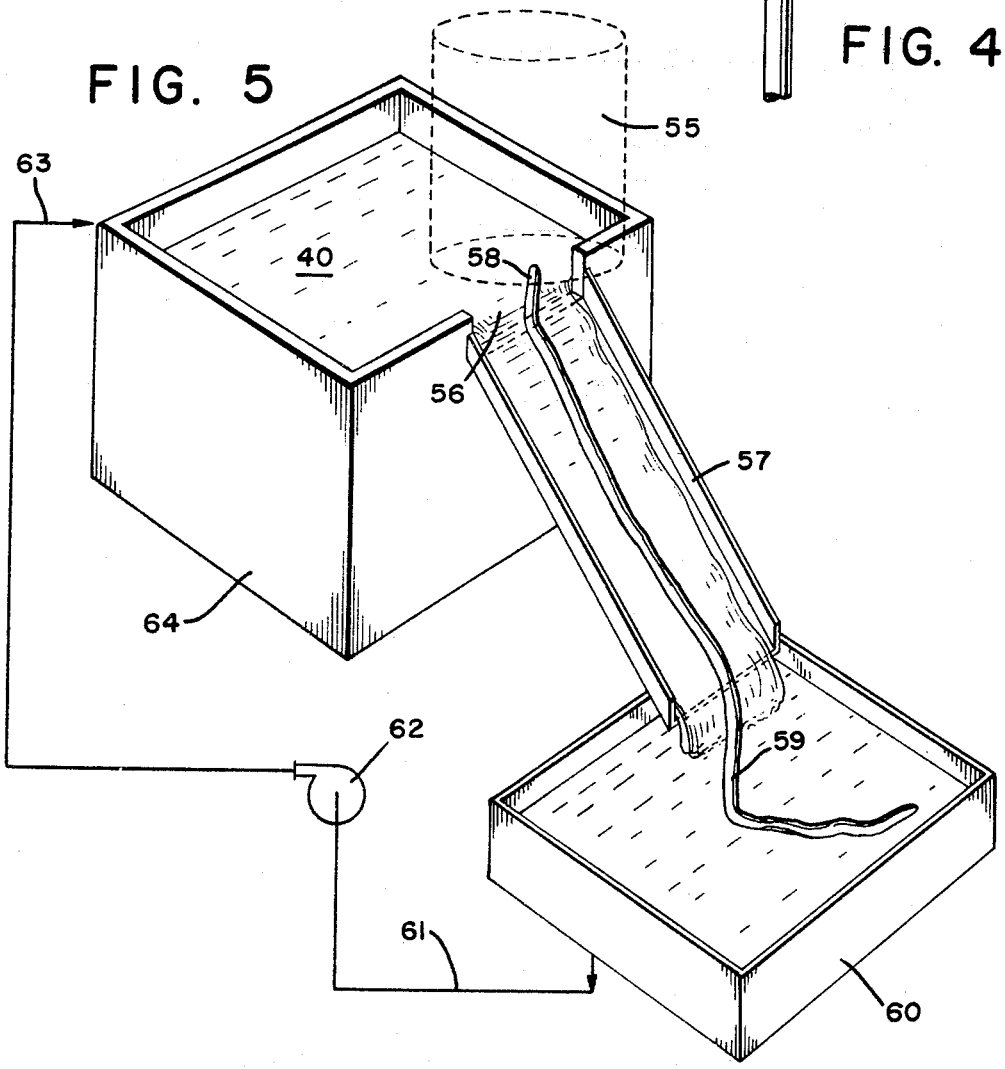

APPARATUS FOR LIQUID QUENCHING OF FREE JET SPUN METAL

This is a division of application Ser. No. 306,472, filed Nov. 14, 1972, now U.S. Pat. No. 3,845,805 issued Nov. 5, 1974.

BACKGROUND OF THE INVENTION

1. Field of the Invention

This invention relates to the free casting of metals and to the filaments which are thereby produced.

2. Description of Prior Art

The preparation of metal wires drawing through a die is an old art which is known to have been practiced by hand at least as early as 1000 A.D. Metal filaments are still principally produced by pulling a large diameter rod through a succession of tapered dies, each one progressively smaller than the one before. In modern practice, the die drawing process has been mechanized, made continuous and automated; yet, the process remains essentially unchanged as do a number of associated problems and limitations.

Research in recent years has been directed toward the development of methods of filament formation which avoid the restrictions of die drawing. One of the approaches under investigation involves free casting or direct melt spinning and concerns the formation of a free jet of molten fluid and the transformation of the jet to the solid state. This procedure may be employed to form filaments of polymeric materials and glasses, i.e. materials having very high viscosities and low surface tension in the liquid state. In contrast, however, metals have relatively inviscid melts of high surface free energy. A cylindrical jet of such a material is inherently unstable. Its surface becomes increasingly perturbed as it issues from the nozzle until at some distance the jet breaks up into droplets. Accordingly, a process, if it is to be capable of producing continuous filaments of metals, must provide a favorable balance between the kinetics of jet solidification and of jet breakup.

Although several processes for the melt spinning of metal fibers have been proposed to effect a stabilization of the molten jet as a means of achieving the required balance, no process has been significantly successful. In one process, the jet is extruded into a gaseous atmosphere capable of chemical reaction with one or more of the components of the jet. Stabilization occurs by formation of a solid sheath or skin on the liqid jet. Alternatively, electrostatic charges have been used to stabilize the jet.

Several techniques have also been proposed for hastening the solidification of the jet. For example, Pond in U.S. Pat. No. 3,602,291 describes cooling of the molten jet by a mist of a vaporizing liquid dispersed in a gas. Schile (U.S. Pat. No. 3,543,831) employs cooling by a gas-solid dispersion. Engelke et al (U.S. Pat. No. 3,347,959) discloses immersing the nozzle from which the molten jet issued in a "liquid mold stream" maintained at a slightly lower temperature than the melt. However, the solidification rate in each of these processes remains farly slow and chemical or electrostatic stabilization of the jet is still required. Additionally, when a nozzle is immersed in the cooling medium, serious practical difficulties are present, e.g. unsuitable quenching and corrosion problems.

The need for chemical stabilization of a molten jet imposes several hardships upon a spinning process; among these are the following:

1. The addition of a reactive element to a pure metal or metal alloy may have a detrimental effect on mechanical, electrical or other of its physical properties.

2. Precise control of melt and/or atmospheric compositions is required, lest the attendant chemical reaction causes plugging of the spinning orifice on the one hand or inadequate stabilization of the jet on the other.

3. The choice of crucible and orifice materials which may satisfactorily resist erosion and chemical attack is limited.

4. The reactive gaseous atmosphere may be noxious, inflammable, explosive, corrosive or expensive.

It is well known that there are a number of disadvantages in working with high electrical potentials to effect electrostatic jet stabilization.

SUMMARY OF THE INVENTION

An object of this invention is to provide a method and apparatus for the production of filaments from their melts which are applicable to materials exhibiting sharp melting behavior and broad melting ranges, i.e. to pure metals and to alloys.

Another object of the invention is to provide a method and apparatus for the production of filaments of this kind from their melts wherein there is no dependency upon special techniques of jet stabilization.

A further object of the invention is to provide a method and apparatus for the production of filaments of metastable alloys, such as amorphous metals and of non-ductile alloys not readily formed into filaments by conventional means.

Still a further object of the invention resides in the preparation of filaments having a fine grained structure of novel orientation.

Other objects and advantages of this invention will be apparent from the following description and drawings.

The melt spinning process of the invention involves the formation of a free jet of the molten material in a gaseous or evacuated environment, traversal of the free jet through an interface into a fluid medium, the fluid medium flowing cocurrent with the jet and at essentially the same velocity as the jet and the rapid solidification of the jet in filamentary form. A free jet is defined as a stream of fluid unconfined by solid boundaries. The fluid medium may be a pure liquid, a solution, an emulsion, or a solid-liquid dispersion. The fluid medium may react with the molten jet to form a stabilizing surface skin or it may be chemically unreactive with the molten jet. The fluid medium and its temperature are selected to suppress formation of a film boiling regime along the jet surface and to enhance the formation of a high heat flux regime, i.e. a nucleate surface boiling regime or a forced convection heat transfer regime in which the coefficient of heat transmission is at least 0.4 cal/sq. cm.—°C-sec.

The terms "film boiling" and "nucleate boiling" are well known in the art. The term "regime" connotes the condition or pattern, usually dynamic, which obtains at a specified point or stage in the process. The quenching of metals in liquids under conventional conditions is disclosed, for example, by Hollomon and Jaffe in "Ferrous Metallurgical Design", pg. 62–65, John Wiley and Sons, New York, 1947. Normally, when the metal is first immersed in the medium, the adjacent liquid is rapidly heated to the boiling point and transformed into vapor. A vapor film is set up around the metal which retards the further transport of heat. A film boiling regime is said to exist.

As the surface temperature falls, the vapor barrier loses integrity and liquid comes into direct contact with the metal. Vapor bubbles form at active nuclei on the metal surface and are quickly detached. Heat transfer is very rapid in this nucleate boiling regime with heat transfer coefficients approximately 30 fold greater than for film boiling. Finally, when the temperature of he liquid at the interface is less than the boiling point, boiling ceases and the metal continues to be cooled rapidly by convection.

In contrast, under the conditions which are described in conjunction with the invention, jets of molten materials entering liquid media demonstrate nucleate surface boiling heat transfer or forced convection heat transfer with total suppression of film boiling along the critical entry region. As a consequence, cooling an solidification of the jets have been greatly enhanced. This result coupled with unexpected stability of molten jets within fluid media has enabled the transformation of the jets into solid filaments in the brief interval before jet disruption. The very rapid heat transfer permits the preparation of substantially improved continuous round filaments of amorphous metals as well as the preparation of novel crystalline filaments of fine grained equiaxed or oriented structure.

BRIEF DESCRIPTION OF THE DRAWINGS

FIG. 3 and FIG. 3*a* illustrate details of an alternate arrangement for preventing vortex formation during quenching.

FIG. 4 illustrates still another means to avoid vortex formation during the quenching step.

FIG. 5 is a perspective illustration of an alternate quenching and filament support arragement for the extruded jet.

DESCRIPTION OF THE PREFERRED EMBODIMENTS

Figure 1:
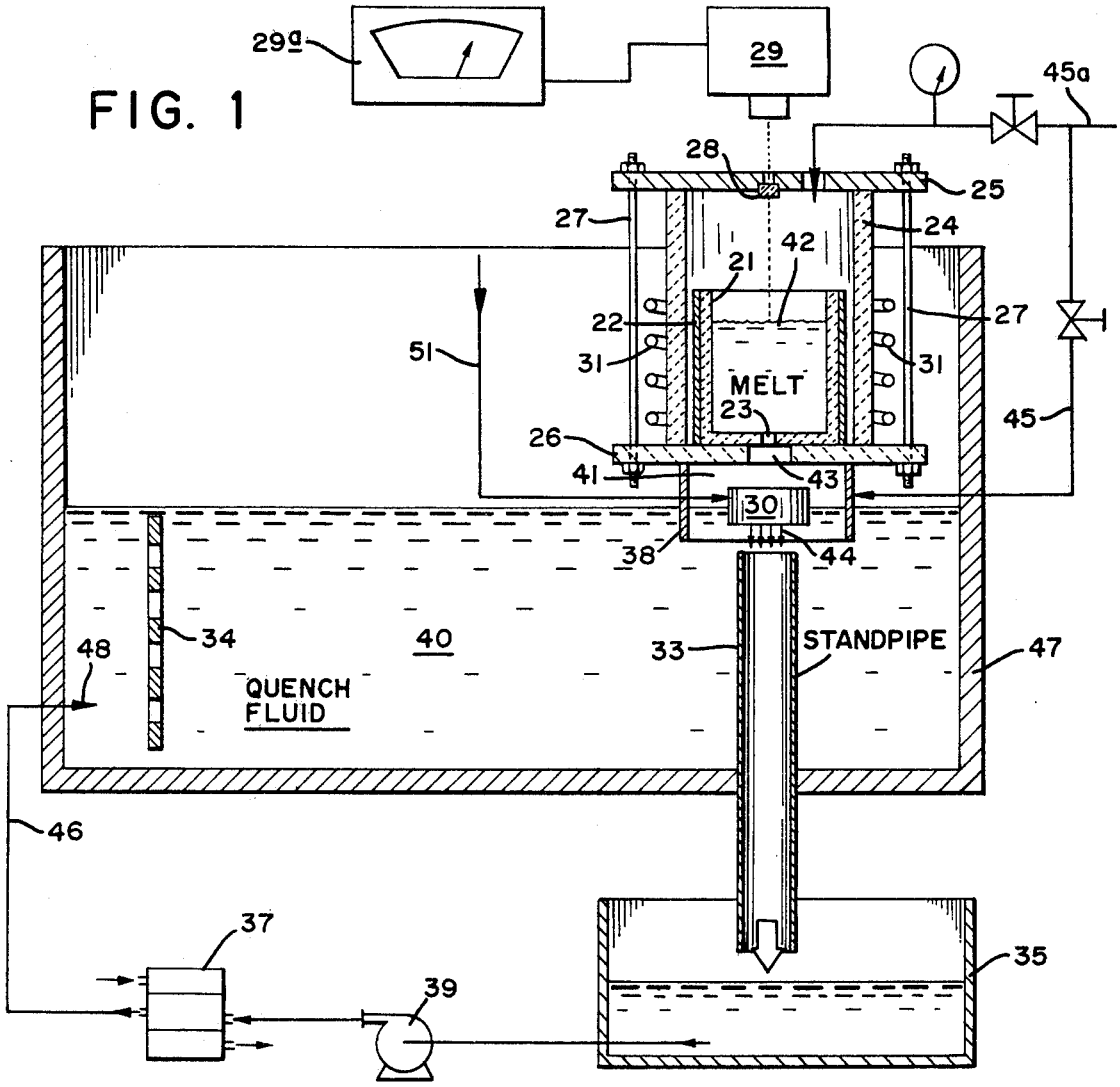
FIG. 1 illustrates diagrammatically an apparatus which may be utilized in making metal filaments according to the invention.

The process and a laboratory spinning apparatus are illustrated in the accompanying FIGS. 1–4. A metallic material to be melt spun is charged to a vessel 21 of suitable heat tolerant material for the particular metal to be processed, e.g. an insulated ceramic crucible fabricated, for example, from quartz or zirconia insulated with zirconia felt 22. The crucible has one or more bottom openings or spinning orifices, one of which is shown at 23 and whose diameters are the order of size of the desired diameter of the filaments, e.g. 0.002–0.060 cm. The crucible 21 lies within a chamber defined by a quartz cylinder 24, an insulated copper plate at the top 25, and a ceramic plate 26 such as boron nitride at the bottom. The chamber assembly is suitably held together such as by external tie rods 27.

A quartz window 28 may be conveniently inserted in the top cover plate to permit measurement of charge temperatures such as by an optical pyrometer 29 which is provided with a suitable readout 29*a.* An inert gas pressure source, e.g. helium, is connected to the top cover plate 25. A pressure tight seal is effected between the crucible 21 and the bottom plate 26 by a suitable commercial ceramic casting compound. For example, when using a quartz crucible and a boron nitride plate, a commercial compound Ceramacast-505, available from Aremco Products Inc., Briarcliffe Manor, N.Y., yields a tight seal. Energy to melt the metal charge is provided by a power source such as a 450 KHZ induction power supply connected to a coil 31 concentrically wound about the melting chamber 24. For example, a quartz crucible having a wall thickness of at least 1 mm may be used with metals whose melting points are less than about 1300°C. The spinning orifices 23 may comprise holes drilled through the bottom wall of the crucible using diamond tools or laser methods although other orifice arrangements or dies may be employed. Since tapered nozzles enhance jet stability, it is preferred that the holes be tapered.

By way of a specific illustration, a zirconia crucible of about ¼ inch wall thickness is preferred for spinning metals whose melting points are 1300°–1700°C. The crucible 31, when formed of zirconia, is drilled and reamed to accept a separately fabricated zirconia spinnerette (not shown) containing the spinning orifices. Mating of the spinnerette to the spinning crucible is accomplished by means of a zirconia based ceramic cement such as Ultratemp 516, available from Aremco Products, inc., Briarcliffe Manor, N.Y.

Other melting chamber materials and configurations are also suitable. For example, when spinning zinc and aluminum, a flanged graphite pressure vessel may be used; and a beryllium oxide crucible may be used in spinning beryllium.

Referring again to FIG. 1, the melting chamber is suspended immediately above a reservoir 47 containing the fluid quench medium 40. The level of the fluid medium 40 is controlled as close as possible but without contacting the bottom plate 26 of the melting chamber 24. Generally, this distance is of the order of about 0.2 cm.

The space 41 between the spinning nozzle and the surface of the fluid quench medium confined by walls 38 may be evacuated or it may be filled with an inert gas or a gas which enhances the formation of a stabilizing skin on the molten filamet jet. This inert or gas filled zone 41 isolates the melting and jet formation zones from the quenching zone and permits the establishment of wide temperature differentials which would not be practical if the chamber 24 and the fluid 40 were in contact. A quartz cylinder 38 cemented on one end to the bottom 26 of the melting chamber and on the other end immersed in the fluid quench medium 40 provides the chamber 41 into which the inert gaseous atmospheres from a source 45*a* through line 45 may be admitted. Alternatively, the space 41 may be evacuated. Within the fluid reservoir 47, disposed vertically below the spinning orifices 23 is a vertical standpipe 33. The fluid quench medium 40 enters the reservoir 47 at one end 48, passes horizontally through a calming screen 34, flows vertically down through the standpipe 33 into a catch basin 35 and finally by means of a pump 39 is passed through a heat exchanger, in this case a refrigeration unit 37, and is returned via line 46 to the reservoir 47. Fine jets of the quench fluid 44 are sprayed from the sparger ring 30 into the mouth of the standpipe 33. It is essential that the quench medium 40 and its temperature be controlled so as to suppress formation of a film boiling regime along the jet interface. Preferably, the quench medium and its temperature are selected to create a nucleate surface boiling regime along the region of entry of the jet into the quench fluid.

The selection of the quench medium and its temperature must be made in relation to the thermal capacity of molten jet. The thermal capacity of the jet increases in direct proportion to its temperature, specific heat, latent heat of fusion and its cross-sectional area. Suppression of film boiling in the thin boundary layer of qunech fluid surrounding the molten jet can be accomplished by causing the thermal capacity of the jet to become depleted in raising the quench fluid boundary layer to the boiling point. Thus, the greater the thermal capacity of the molten jet, the colder must be the quench fluid and/or the higher its specific heat, density, heat of vaporization and thermal conductivity. Other desirable qualities of the fluid quench medium are low viscosity to minimize disruption of the molten jet, nonflammability, non-toxicity, optical clarity and low cost. In accordance with the invention, I have discovered that water at 0°–10°C. is a satisfactory medium for spinning materials whose melting points are less than about 700°C., e.g. aluminum, zinc, lead, tin, bismuth, cadmium, etc. For materials whose melting points are above 700°C. to about 1000°C., however, a refrigerated (−20°C.) 23 weight percent aqueous sodium chloride solution is satisfactory. For spinning materials whose melting points are in the range 1000–1500°C. or 1500–1700°C., a fluid medium of 21.6 weight percent aqueous magnesium chloride at −33°C. or 51 weight percent aqueous zinc chloride at −62°C., respectively, is preferred. It will be understood that the foregoing quench fluids merely represent typical fluids which may be employed in the practice of the present invention and that a variety of alternative quench fluids compatible with the particular jet composition and its temperature may be employed. The quench fluid into which the molten jet is injected is arranged so as to flow cocurrent with the jet and is everywhere during the main quench period, i.e. during the time interval that the molten jet is in its transition to a solid phase, at the same velocity as the jet. In the present apparatus, depicted in the drawing, the molten jet and the quench fluid flow together at substantially the same velocity in the standpipe. Above the standpipe, the motion of the quench fluid is in the same direction as the jet but the fluid velocity accelerates from zero at the air-fluid interface to a maximum in the standpipe.

The top of the standpipe is placed as close as practicable to the surface of the quench fluid; typically, it may be within 2 cm of the fluid surface. Vortex formation above and within the standpipe is substantially minimized by positioning a vortex baffle near the standpipe. Illustrated in FIG. 2 is a simple asymmetric vortex baffle consisting of a bar of rectangular cross section 50 placed to one side of the standpipe and extending to the surface of the fluid 40. In FIG. 3, a vortex baffle comprising an annular sparger ring 30 placed above the standpipe 33 and extending to the surface of the fluid 40 is shown to minimize the vortex formation and control the fluid velocity flow indicated by arrows 52 in standpipe 33. Fine jets of the quench fluid are sprayed from the sparger ring 30 into the mouth of the standpipe 33. The velocity of the fluid medium in the standpipe is determined by the diameter of the standpipe 33, the height of fluid surface above the standpipe, and the velocity and volume of flow sprayed into the standpipe from the sparger ring 30 which is fed from line 51 (also shown in FIG. 1); for example, a typical fluid velocity using a 1.4 cm I.D. standpipe of 40 cm length, an aqueous quench medium of 1.0 cps viscosity, 1.0 g/cc density, a fluid level 2 cm above the standpipe, and zero spray velocity is 200 cm/sec.

As illustrated in FIG. 4, another alternative comprising one or two rotating cylinders (two being shown in FIG. 4) may be placed at the mouth of the standpipe. The presence and rotation of the cylinder 53 and 54 substantially curtails vortex formation and increases the uniformity of the fluid velocity field above the standpipe.

In still a further embodiment of the invention, as shown in FIG. 5, the motion of the quench fluid cocurrent with the molten jet 58 may be motivated by overflowing a weir 56 onto an inclined plane 57. The melting chamber 55 shown in phantom is mounted directly above the inclined plane 57. The solidified jet 59 is collected in a suitable catch basin 60 containing a cooling fluid which is circulated at 61 and returned via pump 62 and line 63 to the reservoir 64. It will be apparent that a suitable arrangement for continuous winding of the filaments passing into the catch basin 60 may be made.

Figure 6:
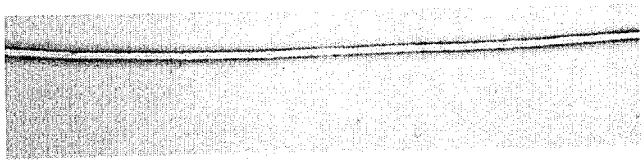
FIG. 6 is a photomicrograph (magnification 6X) of a melt-spun filament made according to the invention and characterized by a smooth surface.
Figure 7:
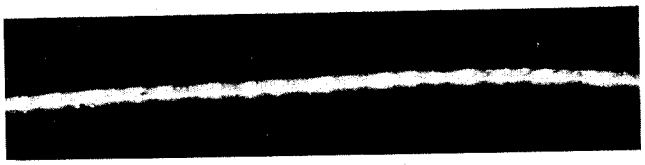
FIG. 7 is photomicrograph (magnification 12X) of a melt-spun filament according to the invention characterized by a corrugate-like surface texture.
Figure 8:
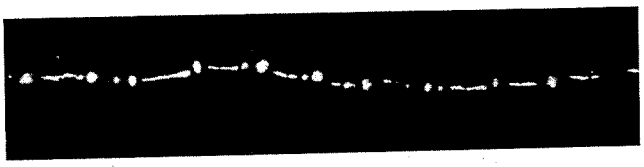
FIG. 8 is a photomicrograph (magnification 6X) of a melt-spun filament made by the invention and having a "pearl necklace"-like surface texture, i.e. a surface texture having alternating linear and spheroidal segments.
Figure 9:
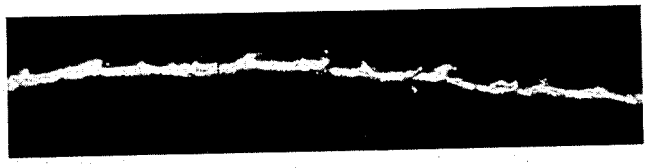
FIG. 9 is a photomicrogrpah (magnification 12X) of a melt-spun filament prepared according to the invention characterized by a serrated or saw-tooth structure.
Figure 10:
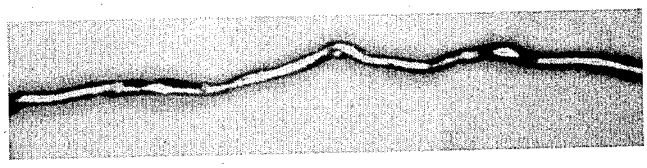
FIG. 10 is a photomicrograph (magnification 12X) of a melt-spun filament prepared according to the invention having a kinked texture.
Figure 11:
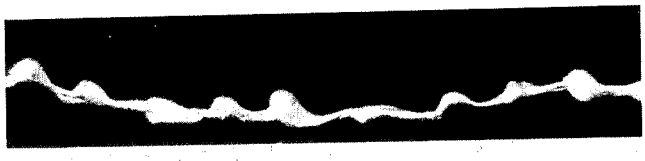
FIG. 11 is a photomicrograph (magnification 12X) of a melt-spun filament prepared according to the invention having a corkscrew-like configuration.

The operation of the melt spinning process is facile and direct. As shown by reference to FIG. 1, the level of the quench fluid 40 in the reservoir 47 and the fluid velocity in the standpipe 33 are adjusted to desired levels. The metal material is charged to the melting receptacle 21 which is substantially sealed off or isolated so that the charge may be preferably melted in an inert atmosphere and at substantially atmospheric pressure. When the metal temperature is approximately 50°–100°C. above the melting point, the pressure of the inert gas in the melting chamber is raised to 10–20 psig or until a molten jet issues from the spinning orifice at the desired velocity. The molten jet is ejected down into the space 41 and thereafter contact quench medium 40 upon entering the standpipe 33 where it is solidified as it moves cocurrently with the fluid moving in the standpipe. Adjustment of spinning conditions to suit the form of the solidified material desired may be effected as noted in conjunction with FIGS. 6–11 of the drawing. Where sinuous filaments are formed, it is an indication that the jet velocity exceeds the fluid velocity in the standpipe. If discontinuous filaments with tapered ends are formed, it is an indication that jet velocity is substantially less than the fluid velocity in the standpipe. If the filaments show axisymmetrical nodes, melt temperature may be reduced to produce smooth continuous filaments. Alternatively, the temperature and pressure may be adjusted to produce filaments of another desired surface texture or length. Some of the filament textures and/or shapes which can be produced by adjustment of the melt temperature and the relative velocity of the molten jet and quench medium are illustrated in FIGS. 6–11 where FIG. 6 illustrates a smooth filament; FIG. 7 a corrugated configuration; FIG. 8 an intermittent globular shapes; FIG. 9 a serrated shape; FIG. 10 has a kinked form and FIG. 11 a spiral or corkscrew configuration.

Some of the factors relating to the control of the process to obtain the desired shape or alternatively to avoid formation shapes undesired shaped are as follows. The smooth filament of FIG. 6, for example, is prepared by matching the fluid velocity in the standpipe to the velocity of the molten jet as described above. The corrugated filament of FIG. 7 may result when the fluid velocity in the standpipe is slower, i.e. about 10% less than the velocity of the jet. The "pearl necklace" appearance of the filament of FIG. 8 may be obtained when the molten jet is superheated, e.g. about 250°C. above its melting point, while the serrated filaments of FIG. 9 may be obtained at conditions otherwise yielding smooth filament but by permitting a vortex to form in the standpipe. This may result even though the jet velocity and the average linear velocity in the standpipe were closely matched. The kinked filaments of FIG. 10 are produced when a fluid velocity in the standpipe is substantially, i.e. about 40%, less than the jet velocity. The corkscrew-like resulting filament of FIG. 11 results from the same conditions as the kinked filaments of FIG. 10 except that a vortex was permitted to form in the standpipe 33.

The invention is further illustrated by consideration of the example which follow. The first two examples demonstrated that the filament forming process of the present invention is based upon achieving high heat flux cooling and that it is independent of special techniques of jet stabilization such as oxide film formation.

EXAMPLE 1

An 8 mm quartz tube whose end was drawn out into a fine tip of 0.025 cm I.D. was charged with silver metal of 99.999% purity. The quartz tube was placed within an induction heating coil and connected to a helium source. The silver was melted under a helium atmosphere and discharged at 1000°C., 10 psig from the quartz tube into the laboratory atmosphere. The velocity of the silver jet determined from the diameter of the jet and the weight of metal collected in a timed period was approximately 250 cm/sec.

A photograph of the molten jet was taken using a 8 microsecond General Radio flash source. The photograph showed the jet became disrupted into discrete droplets at a distance of 0.5 cm from the nozzle or in a time of flight of 2 milliseconds.

The rapid disruption of the jet into droplets was expected since silver is unreactive with oxygen, nitrogen, water vapor and other normal components of the atmosphere and is incapable of forming stabilizing skins with these substances.

EXAMPLE 2

The quartz tube of Example 1 was again charged with silver of 99.999% purity. The quartz tube was mounted over the quench fluid reservoir in the same position but in place of the melting chamber illustrated in FIG. 1. The tip of the quartz tube was 0.2 cm above the surface of a 23% sodium chloride quench fluid maintained at −20°C. The top of the standpipe was 2 cm below the surface of the quench fluid. Fluid velocity in the standpipe was 210 cm/sec.

The silver was melted in a helium atmosphere and the melt extruded from the quartz tube at 1000°C., 10 psig. Jet velocity was approximately 250 cm/sec. The molten silver jet traversed the air gap, entered the quench fluid and was solidified in the form of filaments of 0.025 cm average diameter. High speed macrophotographs of the silver jet entering the quench bath showed nucleate surface boiling and forced convection cooling but not film boiling along the jet.

A lower bound to the coefficient of heat transmission between the jet and the quench fluid may be calculated from the condition that the surface of the jet is solidified before 2 milliseconds have elapsed. The heat transfer coefficient so calculated is at least 0.41 cal/sq.cm-°C -sec. The corresponding quench rate based on the average temperature of the jet is at least $2 \times 10^4$°C/sec. Both the heat transfer coefficient and the quench rate are at least an order of magnitude greater than could be obtained with gaseous cooling.

Examples 3–5 illustrate the novel continuous filament structures obtainable as a result of the rapid solidification intrinsic to the present invention.

EXAMPLE 3

Figure 2:
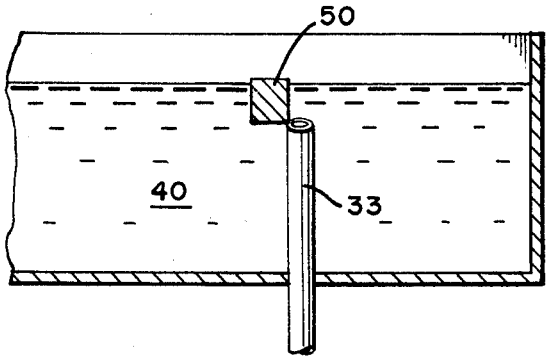
FIG. 2 is a detail of one embodiment of a quenching means wherein a baffle is used to suppress formation of a vortex.

The apparatus depicted in FIG. 1 was charged with a bar of grey iron containing 3.4 weight percent carbon, 2.2 weight percent silicon, 0.6 weight percent maganese, 0.2 weight percent phosphorus and 0.01% sulphur. The alloy was melted in a helium atmosphere at 1200°C. and extruded through an orifice of 0.025 cm diameter at 215 cm/sec. The molten jet was quenched in refrigerated 23 weight percent sodium chloride brine at −20°C. Brine velocity in the standpipe ws 215 cm/sec. Filaments of 0.030 cm diameter were thereby prepared.

Figure 12:
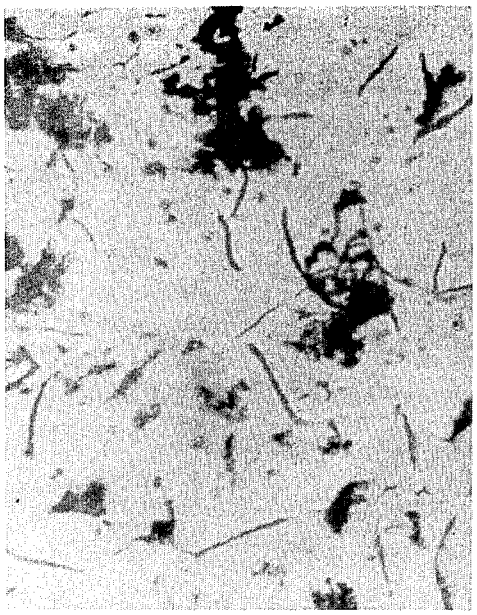
FIG.12 PRIOR ART
FIG. 12 is a photomicrograph (magnification 176X) of across-section of a cast commercial gray iron bar.
Figure 13:
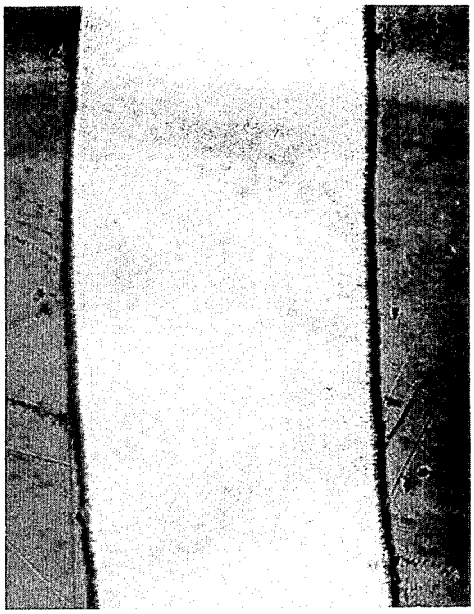
FIG. 13 is a photomicrograph (magnification 176X) of a cross section of a filament melt spun according to the invention from the composition illustrated in FIG. 12.

FIG. 12 is a polished and etched section of the original grey iron bar magnified 176 fold. FIG. 13 is an axial cross section of the melt spun filament prepared as described and shown at the same magnification.

The as-received bar shows large flakes and granules of graphite typical of grey cast iron. However, the filaments melt spun from the above were of a fine grained equiaxed dendritic structure novel for grey iron. Dendrite spacing was 1–2 microns.

Various mechanical and chemical properties of metals such as strength, ductility and resistance to corrosive agents depend significantly on the scales of internal structures or dendrites. It is desirable that the spacing between dendrites be minimal. In typical macroscale castings, dendrite spacings are commonly 100–1000 microns. While Dunn et al in U.S. Pat. No. 3,658,979 disclose dendrite spacings of 5–25 microns in continuous metal filaments, dendrite spacings obtained with the present invention are of the order of 1–2 microns and represent a significant improvement.

The melt spun wire of FIG. 13 was subjected to analysis by x-ray diffraction using MoK$\alpha$ radiation. The phases present in the melt spun wire were metastable $\gamma$-iron (austenite) and $Fe_3C$ (cementite). The equilibrium $\gamma$-iron (ferrite) and graphite phases were not detected. Filaments of metastable $\gamma$-iron, as derived in accordance with the invention, have not previously been prepared from alloys not containing considerable concentrations of manganese, chromium, nickel, cobalt or copper.

EXAMPLE 4

The apparatus depicted in FIG. 1 was charged with an ingot of an alloy composed of 38 at.% iron, 39 at.% nickel, 14 at.% phosphorus, 6 at.% boron and 3 at.% aluminum. The alloy was melted in a helium atmosphere at 1050°C. and extruded through an orifice of 0.008 inch diameter at approximately 200 cm/sec. The molten jet was quenched in refrigerated 21.6% magnesium chloride brine at −30°C. Brine velocity in the standpipe was 195 cm/sec. Continuous filaments of 0.006 inch diameter were thereby prepared. The filaments were examined for crystallinity by x-ray diffraction using MoK$\alpha$ radiation. Only a broad diffraction peak, characteristic of the amorphous state, ws observed. Differential scanning calorimetry showed a crystallization temperature of 424°C. The as-spun filaments were non-crystalline.

EXAMPLE 5

A flanged carbon crucible was charged with electrolytic zinc of 99.99% purity and mounted over the quench fluid reservoir in the same position but in place of the melting chamber of FIG. 1. The zinc was melted in a helium atmosphere and extruded through a 0.025 cm orifice at 430°C. and 4 psig. Water at 11°C. was employed as the quench medium. Water velocity in the standpipe was 151 cm/sec.

Figure 14:
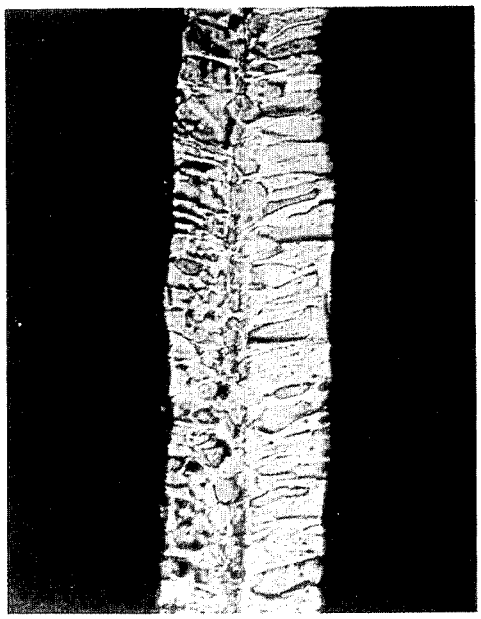
FIG. 14 is a photomicrograph (magnification 145X) of a cross section of melt spun zinc wire prepared according to the invention.
Figure 15:
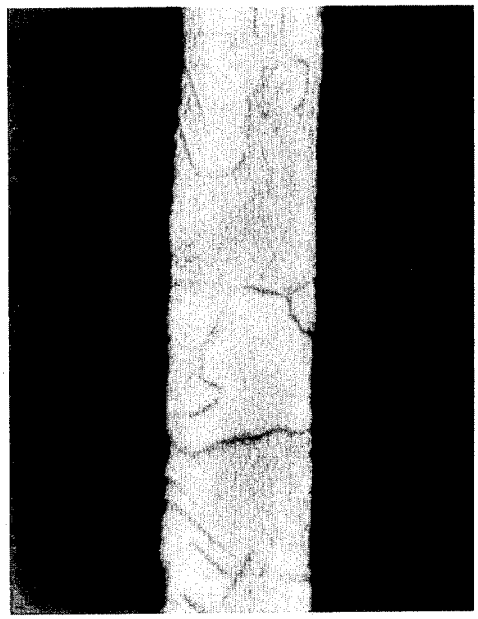
FIG.15 PRIOR ART
FIG. 15 is a comparative photomicrograph (magnification 380X) of a zinc wire made by conventional prior art wire drawing techniques.

Axial cross sections of the melt spun 99.99% zinc wire and a commercial die drawn zinc wire of the same purity are shown in FIGS. 14 and 15. Tensile properties of these materials were as follows:

| | Diam., in. | Ultimate Tensile Strength PSI | % Elong. |
|---|---|---|---|
| Melt Spun Zinc Wire | 0.0068 | 10,770 | 3.4 |
| Die Drawn Zinc Wire | 0.0029 | 7,265 | 3.8 |

The melt spun wire prepared according to the invention showed 48% higher tensile strength than the drawn material. This appears to be the result of a novel wire texture. In the melt spun zinc wire, the columnar grains were inclined 79° to the wire axis, and the grain axis as determined by x-rays were <001> in accordance with the notation described by C. S. Barrett in "Structure of Metals", McGraw Hill Book Company, New York, 1943, pp 9–11.

Zinc is an illustrative example of metal whose crystal structure is hexagonal close packed (H.C.P.). Other examples of H.C.P. metals include beryllium, cadmium, calcium, cerium, chromium, cobalt, erbium, hafnium, holmium, lantanum, magnesium, neodymium, nickel, osmium, praseodymium, rhenium, ruthenium, scandium, thallium, titanium and yttrium. The (001) planes of H.C.P. metals are the primary slip planes of this crystal system. Grain orientation in the melt spun zinc was therefore such that tensile stress along the wire produced nearly minimal shear stress along the (001) slip planes.

In contrast, grain size in the commercially die drawn material was larger and (001) slip planes in the drawn material has been brought into close register with the 45° maximum shear stress plane by the drawing process.

Filaments of H.C.P. metals and their alloys wherein the <001> axis are preferentially oriented at an angle greater than 60° to the filament axis are novel. The crystalline orientation achieved is a result of the high cooling rates (greater than $10^4$°C/sec) achieved in the present invention coupled with preferential growth of H.C.P. metals in the <110> direction.

At lower cooling rates, the inclination of the <001> axis to the filament axis would become smaller. The preferred H.C.P. metals in accordance with the present invention are beryllium, cadmium, cobalt, magnesium, titanium, zirconium and zinc.

EXAMPLE 6

The apparatus of FIG. 1 was charged with a series of pure metals and alloys and filaments were melt spun of these. The alloys and spinning conditions are listed in Table I. Alloys previously described in Examples 1–5 are not included.

TABLE I

Spinning Velocities — 180–260 cm/sec.

| Alloy[a] | Melt Temp., °C. | Quench Medium[b] | Quench Temp.,°C | Filament Diam.,In. |
|---|---|---|---|---|
| Titanium ASTM B265-58T (5% Al, 4% V) | 1700 | $ZnCl_2$ | −62 | 0.006 |
| Palladium (99.85%) | 1600 | $ZnCl_2$ | −62 | 0.010 |
| Iron 1010 Steel (0.10% C, 0.45% Mn) | 1580 | $ZnCl_2$ | −62 | 0.006 |
| Cobalt (0.6% Ni, 0.2% Fe) | 1550 | $ZnCl_2$ | −62 | 0.006 |
| Nickel (99.9%) | 1500 | $ZnCl_2$ | −62 | 0.006 |
| Silicon (97%) | 1500 | $ZnCl_2$ | −62 | 0.006 |
| Manganese (0.05% Fe) | 1300 | $MgCl_2$ | −33 | 0.006 |
| Copper 99.95% Cu, 0.04% O | 1100 | $MgCl_2$ | −33 | 0.006 |

TABLE I-continued

| Alloy[a] | Spinning Velocities — 180–260 cm/sec. Melt Temp., °C. | Quench Medium[b] | Quench Temp.,°C | Filament Diam.,In. |
|---|---|---|---|---|
| 99% Cu, 1% Cd | 1100 | $MgCl_2$ | −33 | 0.006 |
| Gold (99.9%) | 1100 | NaCl | −20 | 0.006 |
| Aluminum | | | | |
| 1100 Alloy (99.0 + % Al) | 680 | water | 10 | 0.005–0.060 |
| 6063 Alloy (0.7% Mg, 0.4% Si) | 680 | water | 10 | 0.005–0.030 |
| Magnesium | | | | |
| AM 100A Alloy (10% Al, 0.1% Mn) | 625 | water | 1 | 0.008 |
| Zinc | | | | |
| AC 41A Alloy (4% Al, 1% Cu, 0.04% Mg) | 450 | water | 10 | 0.012 |
| Lead (99.9%) | 350 | water | 1–20 | 0.006 |
| Lead-Tin Solder (50% Pb, 50% Sn) | 220–280 | water | 1–20 | 0.005–0.030 |
| Tin (99.9%) | 235–600 | water | 1–20 | 0.006–0.012 |

[a]Alloy contents are expressed in weight %.
[b]Quench media:
$ZnCl_2$ — 51 wt. % Aqueous Zinc Chloride
$MgCl_2$ — 21.6 wt. % Aqueous Magnesium Chloride
NaCl — 23.3 wt. % Aqueous Sodium Chloride The following examples illustrate chemical stabilization of a molten jet in a liquid medium.

EXAMPLE 7

An 8 mm quartz tube whose end was drawn out into a fine tip of 0.015 cm I.D. was charged with the same copper metal of 99.95% purity cited in Table I. The quartz tube was mounted over the quench fluid reservoir in the same position but in place of the melting chamber illustrated in FIG. 1. The tip of the quartz tube was 0.2 cm above the surface of a 23.3 weight percent sodium chloride quench fluid maintained at −20°C. The top of the standpipe was 2 cm below the surface of the quench fluid. Fluid velocity in the standpipe was 220 cm/sec.

The copper was melted in a helium atmosphere and the melt extruded from the quartz tube at 1100°C., 220 cm/sec. The molten copper traversed the air gap and entered the quench fluid. The molten jet was disrupted in the quench fluid and solidified as discrete spheroidal particles. In contrast to the result cited in Table I using a magnesium chloride brine at −30°C., copper filaments were not obtained with the less rapid quenching afforded by sodium chloride brine at −20°C.

EXAMPLE 8

The quartz tube of Example 7 was again charged with copper of 99.95% purity. The copper was melted in a helium atmosphere and the melt extruded at 1100°C., 220 cm/sec. The tip of the quartz tube was 0.2 cm above the surface of a quench fluid consisting of 23.3 weight percent sodium chloride and 10 weight percent $Na_2S \cdot 9H_2O$ maintained at −20°C. The standpipe position and fluid were as in Example 7.

The molten copper jet traversed the air gap, entered the quench fluid and was solidified as a 0.015 cm diameter filament. The surface of the filament was covered with a dark deposit identified as copper sulfide. The formation of a copper sulfide film on the molten jet within the quench fluid had increased the stability of the jet to the point where solidification in filamentary form could be effected.

Various modification and variations of the present invention are possible without departing from the spirit or essential characteristics thereof. The present embodiment is therefore to be considered in all respects illustrative and not restrictive, the scope of the invention being indicated by the appended claims and all changes which come within the meaning and range of equivalency are intended to be embraced therein.

I claim:

1. An apparatus for the production of filament from a melt of normally solid material comprising:

a. a melting chamber adapted to receive said material, said chamber including means to melt said material and means to control the environment therein;

b. an extrusion orifice in the bottom of said melting chamber, adapted for extruding a filament of molten material;

c. an interface chamber below said orifice through which said filament is adapted to pass, said interface chamber including means for providing an evacuated space or controlled gaseous atmosphere therein; and d. reservoir disposed below said interface chamber into which filament is adapted to be introduced, said reservoir comprising a liquid quenching medium adapted to move cocurrently with the molten filament introduced therein.

2. The apparatus of claim 1 including a vertical standpipe immersed below the surface of the liquid quench medium adapted to receive the liquid quench medium in an essentially vertical direction.

3. The apparatus of claim 1 including means adapted to prevent vortex formation positioned continguous to the point in reservoir (d) into which the molten filament is adapted to be introduced.

4. The apparatus of claim 2 including means for injecting jets of the quench medium into the upper end of said standpipe to inhibit vortex formation in said quench medium.

5. The apparatus of claim 3 including a rotating cylinder positioned continguous to said point into which the molten filament is adapted to be introduced, said cylinder adapted to rotate so as to move the quench medium surface in a direction cocurrent with the movement of the filament.

6. The apparatus of claim 1 including a weir in said reservoir adapted for overflow of the liquid quench medium in an essentially vertical direction.

* * * * *